US005821486A

United States Patent [19]

Paw et al.

[11] Patent Number: 5,821,486

[45] Date of Patent: Oct. 13, 1998

[54] SWITCH FOR HOOKSTICK OPERATION

[75] Inventors: Kacey J. Paw, Chicago; Richard H. Hawkins, II, Country Club Hills; William D. Isherwood, Jr., Lincolnshire, all of Ill.

[73] Assignee: S&C Electric Company, Chicago, Ill.

[21] Appl. No.: 703,265

[22] Filed: Aug. 26, 1996

[51] Int. Cl.[6] ..... H01H 31/00

[52] U.S. Cl. ..... 200/48 A; 200/48 R

[58] Field of Search ..... 200/48 R, 48 P, 200/48 A, 48 KB, 48 V, 48 OB, 49

[56] References Cited

U.S. PATENT DOCUMENTS

| | | | |
|---|---|---|---|
| 2,710,897 | 2/1955 | Lindell | 200/48 R |
| 3,165,601 | 1/1965 | Bohler | 200/48 R |
| 3,499,129 | 3/1970 | Hulteen et al. | 200/48 R |
| 5,091,616 | 2/1992 | Ramos et al. | 200/48 A |
| 5,268,543 | 12/1993 | Ramos | 200/48 A |

*Primary Examiner*—David J. Walczak
*Attorney, Agent, or Firm*—James V. Lapacek

[57] ABSTRACT

A gang-operated multi-pole switch is provided including an operating handle suitable for manual operation via a hookstick and including an open-position retention arrangement. The open-position retention arrangement includes a first member movable with the operating handle which coacts with a second member. In a preferred arrangement, the first member extends radially from the operating shaft of the operating handle and the second member is a spring plate including a retention surface and disposed in the path of the first member.

10 Claims, 5 Drawing Sheets

SWITCH FOR HOOKSTICK OPERATION

BACKGROUND OF THE INVENTION

1. Field of the Invention

The present invention relates generally to the field of electrical switches for the electrical power transmission and distribution, and more particularly to a gang-operated multi-pole switch which is operable by manipulation of an operating handle via a hookstick.

2. Description of the Related Art

Various switches for the electrical power transmission and distribution field are multi-pole gang-operated switches. Load interrupter switches include the capability to be opened while under load conditions, i.e. while load current is flowing through the switch. For example, see U.S. Pat. Nos. 4,126,773 and 5,091,616 and a variety of switch products available from the S&C Electric Company, Chicago, Ill. 60626. These switches may be arranged for either single-pole operation or as a gang-operated multi-pole switch. Operation is through an operating mechanism either manually or power driven.

One type of interrupter switch, termed a series interrupter, carries the load current during normal operation and is actuated to interrupt the load current. For example, an interrupter of this type is shown in the aforementioned U.S. Pat. No. 5,091,616, wherein the housing that carries the interrupter is rotated to provide an additional disconnect function after the interrupting contacts are opened. This arrangement also includes a handle for ganged operation of the disconnect function via a hookstick.

With reference to the aforementioned U.S. Pat. No. 4,126,773, a second type of interrupter switch, termed a shunt interrupter, provides actuation of the interrupter via a cam carried by a movable switch blade which also carries a movable main contact. In the shunt interrupter switch, load current is first shunted or transferred to the interrupter from the main current path and then the interrupter is opened to interrupt the circuit. Another interrupter switch of this type includes a hookstick-operable mechanism with a motor to provide manual open and close operation, as shown in Kearney Publication Section 915L (also identified as 1995 Kearney 09/95 25K).

While the prior art arrangements may be useful to provide switches with various features, these prior arrangements do not provide desirable operational features for manual operation.

SUMMARY OF THE INVENTION

Accordingly, it is a principal object of the present invention to provide a gang-operated multi-pole switch with an operating arrangement that includes features for hookstick operation.

It is another object of the present invention to provide a gang-operated multi-pole interrupter switch that includes an operating handle in the primary area adjacent the switch mounting base to drive the interrupter operating linkage.

It is a further object of the present invention to provide a hookstick-operable multi-pole switch with operational features including a positive retention mechanism for the open switch position.

These and other objects of the present invention are efficiently achieved by the provision of a gang-operated multi-pole switch including an operating handle suitable for manual operation via a hookstick and including an open-position retention arrangement. The open-position retention arrangement includes a first member movable with the operating handle which coacts with a second member. In a preferred arrangement, the first member extends radially from the operating shaft of the operating handle and the second member is a spring plate including a retention surface and disposed in the path of the first member.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
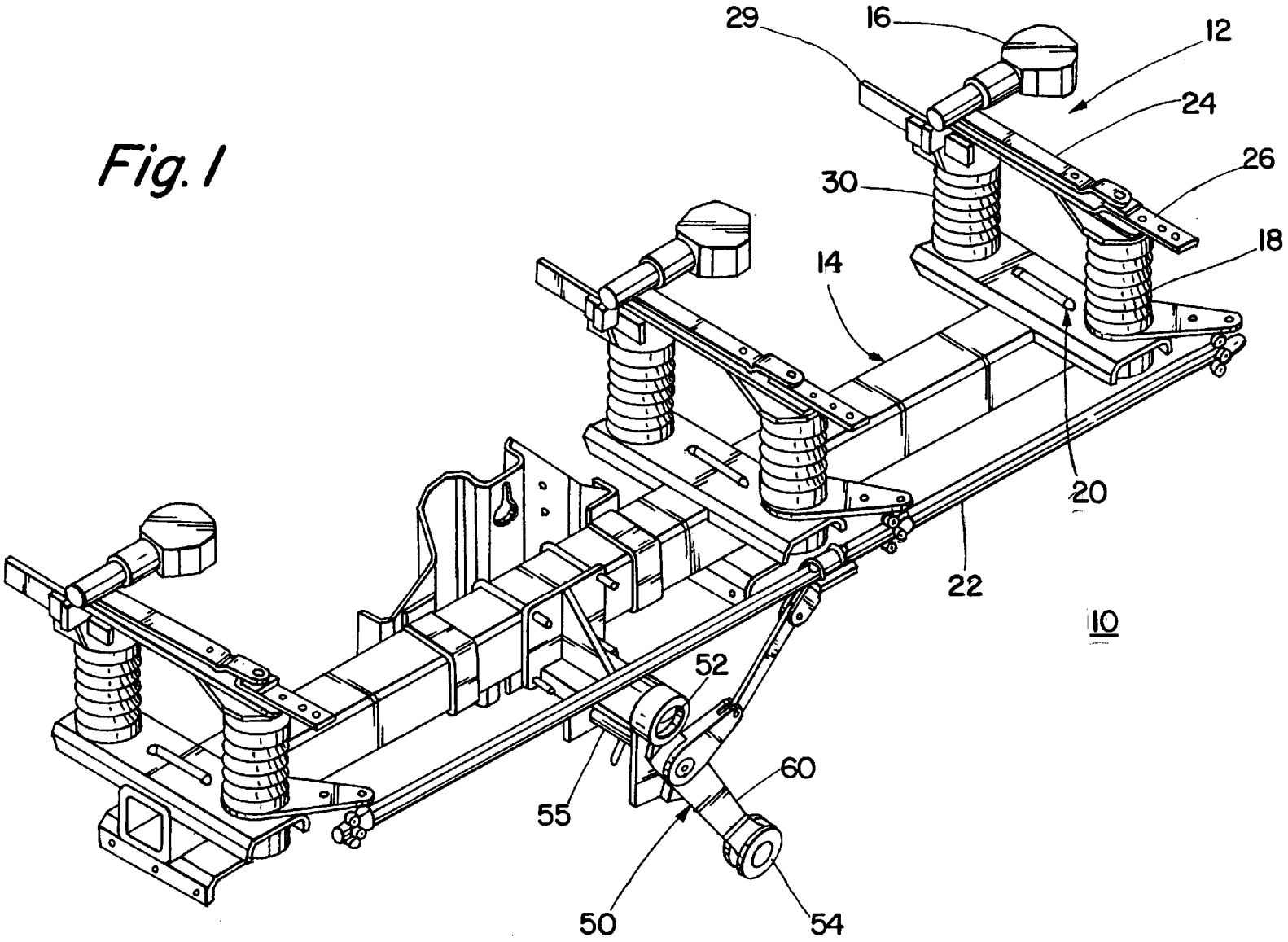
FIG. 1 is a perspective view of an illustrative switch in accordance with the present invention, with some parts removed for clarity.
Figure 2:
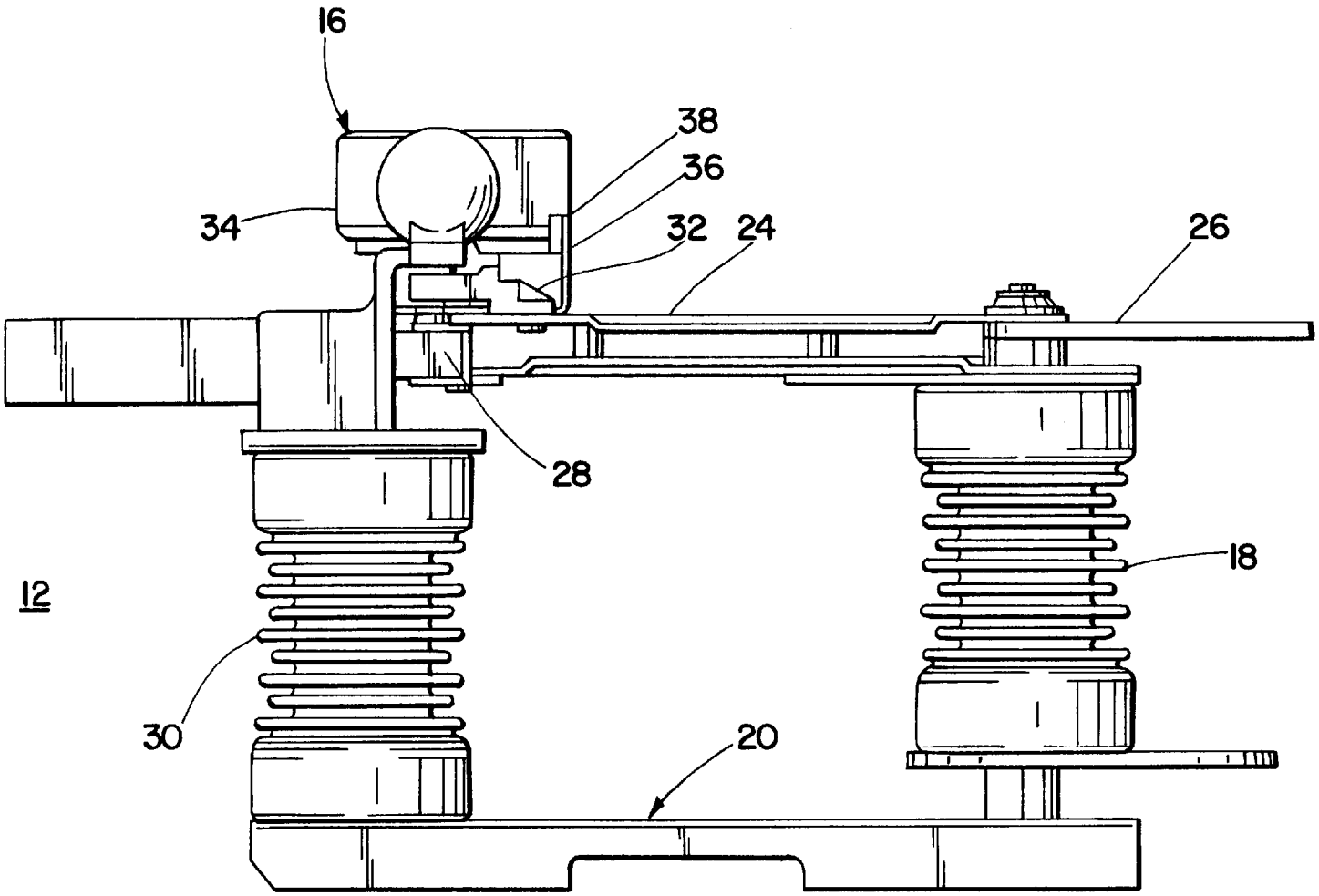
FIG. 2 is a left-side elevational view of one of the switch pole units of FIG. 1 and illustrating further structure of the switch of FIG. 1.

Referring now to FIGS. 1 and 2, the switch 10 is useful for illustration of the present invention. The illustrative switch 10 is a gang-operated multi-pole load interrupter switch that includes a number of switch pole-units 12 mounted on a base 14. However, it should be noted that the present invention is applicable to various types of switches including disconnect switches and various configurations of interrupter switches of both the series and shunt operation variety.

In the specific illustration in FIG. 1, which is also typical for electrical power distribution systems, three switch pole units are provided for three-phase distribution systems. The switch pole units 12 include interrupters 16 which include internal interrupting contacts (not shown). The interrupters 16 are operated via rotation of insulators 18 which are rotatably mounted with respect to a switch pole base 20. An operating linkage 22 is attached to drive each of the insulators 18 of each switch pole unit 12. The insulators 18 each carry a switch blade 24 which is pivotally connected to a main contact terminal pad 26 at the top of each of the insulators 18. A stationary main contact tongue 28 (FIG. 2) is carried by the interrupter 16 which is supported by an insulator 30 affixed to the switch pole base 20. The switch blade 24 in a closed position engages the main contact 28. The switchblade 24 also carries an actuating cam 32 (FIG. 2) which is arranged to operate the interrupter 16 between open and closed positions via interaction with a trigger 34 (FIG. 2). The switch blade 24 also carries a shunt contact 36 (FIG. 2) which cooperates with an external interrupter contact 38 (FIG. 2) of the interrupter 16 to transfer current to the internal contacts of the interrupter 16 during opening movement of the switchblade 24.

In the closed position, load current flows between the terminal pad 26 and the main contact 28, which is connected to a terminal pad 29, the terminal pads 26 and 29 being provided for connection to the electrical system. When the switchblade 24 is rotated out of the closed position, the load current is transferred through the interrupter 16 via the shunt contact 36 and the external interrupter contact 38. As the switchblade 24 is opened farther and after the main contacts 24, 28 have been separated a suitable distance, the interrupter 16 is opened by action of the actuating cam 32 and the trigger 34. On closing, the switchblade actuating cam 32 interacts with the trigger 34 to close the interrupter 16 with the switchblade 24 closing on the main contact 28, the interrupter 16 being ready for the next opening and interruption operation.

Figure 3:
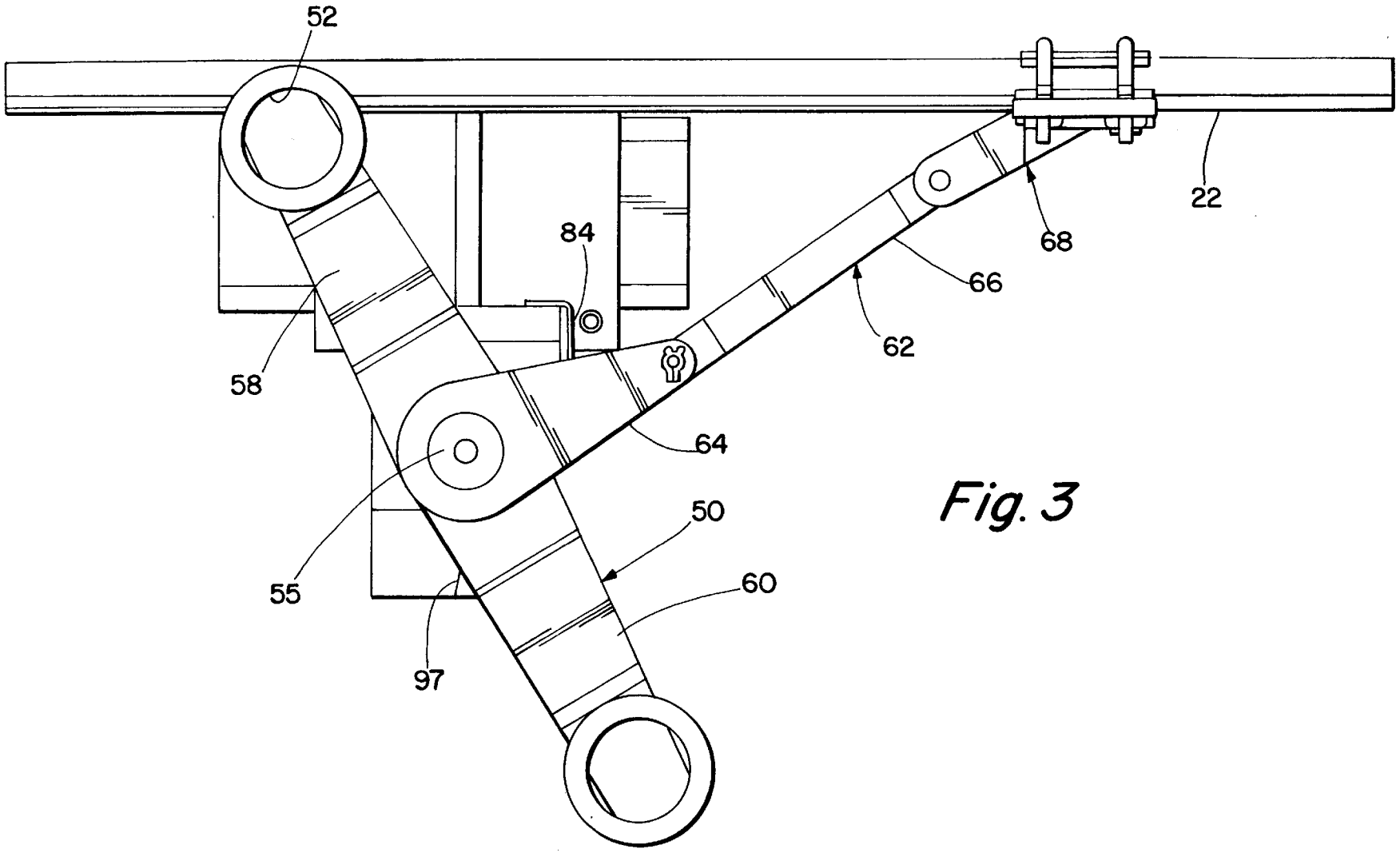
FIGS. 3 and 4 are respective partial front and right-side elevational views of the switch of FIG. 1 illustrating an operating handle and retention arrangement of the present invention.
Figure 4:
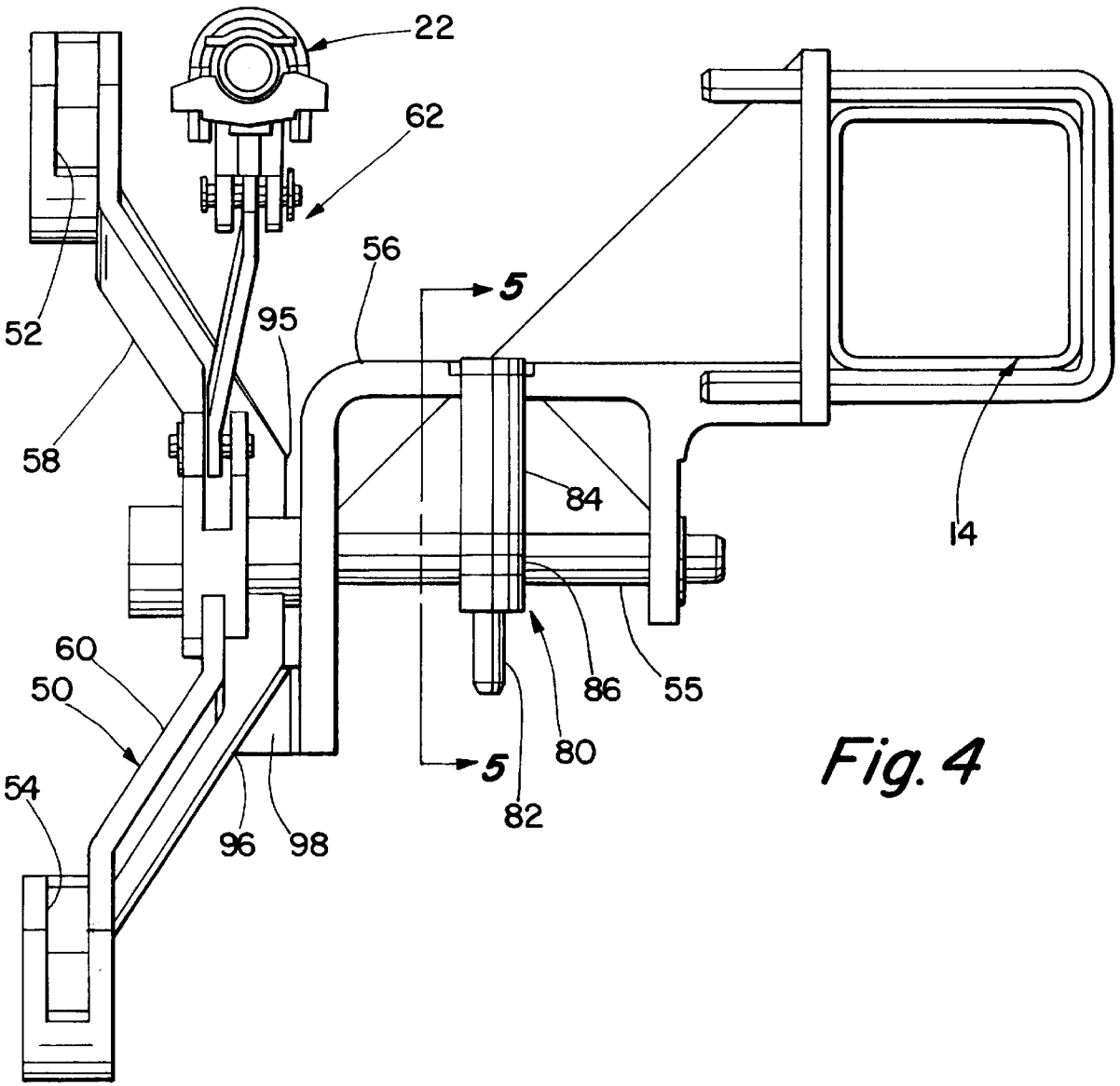

In accordance with important aspects of the present invention and referring now additionally to FIGS. 3 and 4, a handle 50 is provided to operate the switch 10 via connection to the operating linkage 22. The handle 50 includes features 52, 54 that are adapted for use with a hookstick, e.g. a straight prong at the end of a hookstick. The handle 50 is pivotally mounted with respect to the base 14 via a support/mounting arrangement 56 and a shaft 55 so as to be adjacent to the switch pole units 12, and thus located just below the primary area of the distribution system when the switch 10 is installed. Each of the features 52, 54 is provided as a pull ring at the end of a respective operating arm 58, 60. In the closed position as shown in FIGS. 1, 3 and 4, the handle 50 is operated to open the interrupter switch 10 by pulling down on the arm 58 counterclockwise in FIG. 3. In the open position, the interrupter switch 10 is closed by pulling down on the arm 60. The handle 50 includes a coupling arrangement, generally referred to at 62, to drive the operating linkage 22. Specifically, a crank arm 64 of the handle 50 is attached so as to pivot with the shaft 55. A coupling link 66 is pivotally connected at one end to the crank arm 64. The other end of the coupling link 66 is pivotally connected to an extending portion of a clevis 68 carried by the operating linkage 22. In the fully closed position, the overall handle 50 with crank arm 64 and the coupling arrangement 62 are arranged to achieve an over-toggle relationship. This feature serves to maintain the switch 10 in a closed position.

Figure 5:
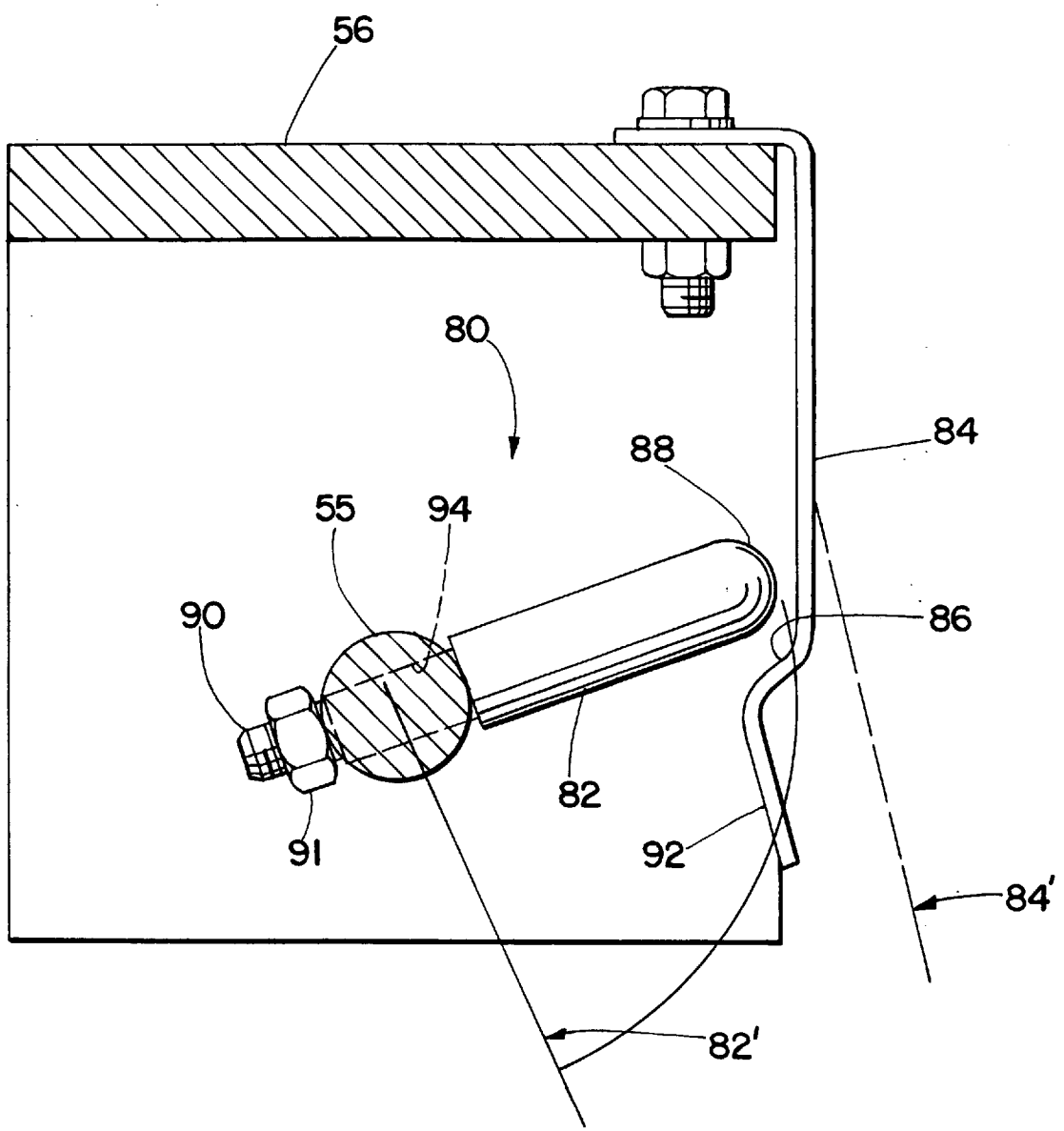
FIG. 5 is an elevational view, partly in section, taken along the line 5—5 of FIG. 4.

In accordance with further important aspects of the present invention, when the interrupter switch 10 is operated from the closed position to the open position, the operating linkage 22 is positively retained in the open position so as to restrain and prevent inadvertent movement out of the open position, e.g. due to forces on the operating linkage 22 such as wind etc. acting on the components of the interrupter switch 10. Referring additionally now to FIG. 5, a retention arrangement 80 (FIGS. 4 and 5) includes a pin 82 carried by the shaft 55 so as to extend radially therefrom. Further, the retention arrangement 80 includes a spring plate 84 that extends from the support/mounting arrangement 56 so as to be adjacent the end 88 of the pin 82. The spring plate 84 includes a predetermined retention surface 86 which in combination with the rounded end 88 of the pin 82 defines a positive retention position or detent with the switch 10 in the open position. The retention arrangement 80 is shown in FIG. 5 in the open position of the interrupter switch 10. The position of the pin 82 in the closed position is shown at 82'.

When the handle 50 and the operating linkage 22 are moved from the closed position toward the open position, as the shaft 55 rotates counterclockwise, the pin 82 contacts the spring plate 84 at and moves along an angled surface portion 92, deflecting the spring plate 84 to the right and moving upward along the spring plate 84 and past the surface 86 whereupon the spring plate 84 deflects to the left with the end 88 of the pin 82 moving passed the surface 86. In this open position as shown in FIG. 5, the operating linkage 22 may not be moved toward the closed position without sufficient force being exerted on the shaft 55 to rotate the pin 82 against the surface 86 so as to deflect the spring plate 84 to the position shown as 84'. When it is desired to close the interrupter switch 10, the handle 50 is rotated clockwise (FIGS. 3 and 5) with sufficient force to deflect the spring plate 84 and drive the operating linkage 22 to rotate the insulators 18 and close the interrupter switch 10.

The material and dimensions of the spring plate 84 and the dimensions and angle of orientation of the surface 86 are chosen to provide the desired retention force in the open position, i.e. to resist movement out of the open position. The angle of the surface 86 with respect to the spring plate 84 establish a significantly higher force to move the pin 82 out of the open position as compared to the force when rotating the pin 82 counterclockwise and upward along the spring plate 84 when moving from the closed position into the open position. This is a desirable attribute so as to establish a high retention force in the open position while not unduly adding to the operating force to open the switch. The rounded end 88 of the pin 82 assists smooth operation and long lifetime of the components of the retention arrangement 80. The materials of the pin 82 at end 88 and the spring plate 84 also need to be complementary such that undue galling or wear between the surfaces is prevented. For example a spring plate 84 fabricated from stainless steel and a pin 82 fabricated from a phosphor-bronze alloy have been found to be suitable to practice the invention. As shown in FIG. 5, the pin 82 may be affixed to the shaft 55 via a threaded portion 90 and a nut 91 threaded thereon, the threaded portion 90 passing through a passage 94 formed through the shaft 55.

The handle 50 includes control surfaces 95, 96 on the respective arms 58, 60 which coact with stop surfaces 97, 98 on the support/mounting arrangement 56 so as to define a respective open stop and an overtravel closed stop.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A group-operated electrical interrupter switch for performing an interrupter function and having multiple switch poles, the group-operated interrupter switch comprising:

a plurality of interrupter switches each of which includes interrupter actuator means for actuating said respective interrupter switch; and means for supporting said plurality of interrupter switches;

operating linkage means for actuating said interrupter actuator means;

an operating handle movable between open and closed positions and coupled to said operating linkage means to drive said operating linkage means between open and closed positions, said operating handle including operating means for cooperating with a predetermined tool fitting whereby said operating handle may be moved between said open and closed positions to perform the interrupting function; and means operative as said operating handle is moved to said operating linkage means between said closed and open positions for retaining said operating handle and said operating linkage means in said open position and resisting movement of said operating handle and said operating linkage means out of said open position without sufficient force being exerted on said retaining means by said operating handle.

2. The group-operated electrical interrupter switch of claim 1 wherein said retaining means comprises first means movable with said operating handle cooperating with second means supported by said supporting means.

3. The group-operated electrical interrupter switch of claim 2 wherein said second means comprises a spring plate defining a retention position for said first means.

4. The group-operated electrical interrupter switch of claim 3 wherein said operating handle includes an operating shaft, said first means comprising a member extending radially from said operating shaft.

5. The group-operated electrical interrupter switch of claim 4 wherein said spring plate includes a predetermined curved surface characteristic which defines said retention position.

6. The group-operated electrical interrupter switch of claim 4 wherein said member includes a rounded outer end.

7. The group-operated electrical interrupter switch of claim 1 wherein said operating handle includes two actuator portions each of which includes a passage formed therethrough.

8. A group-operated electrical interrupter switch for performing an interrupter function and having multiple switch poles, the group-operated interrupter switch comprising:

a plurality of interrupter switches each of which includes interrupter actuator means for actuating said respective interrupter switch;

linkage means for actuating said interrupter actuator means;

operating means movable between open and closed positions and coupled to said linkage means to drive said linkage means between open and closed positions, as said operating means moves said open and closed positions, said operating means including means for cooperating with a predetermined tool fitting whereby operating means may be moved between said open and closed positions to perform the interrupting function; and means for resisting movement of said operating means away from said open position comprising a first member extending from said operating means coacting with a second member which is arranged to apply restraining forces to movement of said first member whereby said operating means is movable out of said open position only upon sufficient force being exerted to overcome said restraining forces.

9. A group-operated electrical switch having multiple switch poles comprising:

a plurality of switches movable between open and closed positions;

means for moving said switches between said open and closed positions;

means for supporting said plurality of switches and said moving means;

operating means mounted with respect to and adjacent said supporting means and being movable between open and closed positions to actuate said moving means, said operating means including open and close control means whereby said operating means may be moved between said open and closed positions to perform the interrupting function; and means for retaining said operating means in said open position, said retaining means being rendered operative by movement of said operating means from said closed position into said open position as said moving means is actuated to move said switches between said closed and open positions.

10. The group-operated switch of claim 9 wherein said retaining means includes first means movable with said operating means and second means being engaged by said first means during movement of said first means between closed and open positions.

* * * * *